United States Patent [19]

Hardy et al.

[11] Patent Number: 4,842,752

[45] Date of Patent: Jun. 27, 1989

[54] STABLE EXTREME PRESSURE GREASE

[75] Inventors: Bryant J. Hardy; Charles J. Swartz, both of Ponca City, Okla.

[73] Assignee: Conoco Inc., Ponca City, Okla.

[21] Appl. No.: 171,987

[22] Filed: Mar. 22, 1988

[51] Int. Cl.[4] ..... C10M 169/06; C10M 117/04

[52] U.S. Cl. ..... 252/17; 252/42; 252/47

[58] Field of Search ..... 252/17, 32.5, 42, 47

[56] References Cited

U.S. PATENT DOCUMENTS

| | | | |
|---|---|---|---|
| Re. 23,243 | 6/1950 | Bondi | 252/42 |
| 2,362,767 | 11/1944 | Morgan | 252/42 |
| 2,398,173 | 4/1946 | Brunstrum et al. | 252/42 |
| 4,435,299 | 3/1984 | Carley et al. | 252/41 |
| 4,582,616 | 4/1986 | Kita et al. | 252/42 |

FOREIGN PATENT DOCUMENTS

| | | |
|---|---|---|
| 1090804 | 10/1960 | Fed. Rep. of Germany . |
| 60-173097 | 9/1985 | Japan . |
| 830887 | 3/1960 | United Kingdom . |

*Primary Examiner*—Jacqueline V. Howard
*Attorney, Agent, or Firm*—C. R. Schupbach

[57] ABSTRACT

A stable extreme pressure grease comprising a base oil, a soap and an EP agent, in the preparation of which excess soap is provided for reaction with the EP agent whereby the thickening effect of the remaining soap in the grease is retained.

13 Claims, No Drawings

STABLE EXTREME PRESSURE GREASE

BACKGROUND AND SUMMARY OF THE INVENTION

1. Field of the Invention

This invention concerns novel and improved grease compositions comprising a base oil, an EP agent and an amount of soap in excess of that required to thicken said composition to the desired grease viscosity.

The traction motor gear box which forms a part of the drive train for locomotives requires a high-viscosity grease with high film strength. In order to meet the specifications set by the users for such greases, manufacturers of formulations must incorporate film strength additives, or as they are generally known EP (Extreme Pressure) additives, in their greases. In addition, the amount and kind of soap thickener used in the greases must be selected to maintain a high viscosity in the product. Typical specifications for tractor motor gear box greases are shown in Table 1.

TABLE 1

TRACTION MOTOR GEAR BOX SPECIFICATIONS FOR LITHIUM BASE GREASES

| | General Electric | General Motors |
|---|---|---|
| Brookfield Viscosity @ 200° F. | | |
| #4 Spindle at 20 RPM | 7000 cP | |
| #3 Spindle at 4 RPM | | 5000–10000 cP |
| 4 ball E.P. Test | | |
| Load Wear Index | 50 kgf (min) | 40 kgf (min) |
| Weld Point | 300 kgf (min) | 200 kgf (min) |
| Timken | 40 lbs, OK Load | — |
| Base Oil Viscosity | 1500 SSU at 210° F. | 1500–2000 SSU at 210° F. |

Typically, grease formulators have had difficulty in maintaining the desired viscosities of greases during their use in tractor motor gear boxes. A testing program was set up to determine, if possible, the reasons for the failure of greases to meet specifications and to find a solution to the problem or problems. In addition to failure of greases during use, problems have been encountered with substantial viscosity loss during shipment of greases in heated railway cars to prospective users.

The greases studied in the test program each contained a soap or soaps, one or more EP agents, and various base oils. One of the soaps used was a standard soap, lithium 12-hydroxy stearate. Also tested were greases containing complex soaps which were a mixture of lithium 12-hydroxy stearate and the lithium salt of adipic acid. The EP agents used in the greases were Lubrizol 6063, a sulfurized ester of an organic phosphate; Lubrizol 887, zinc dithiophosphate and sulfurized ester; Sulperm 110, a sulfurized synthetic sperm oil; and Hitec 2319, a sulfurized ester of an organic phosphate. Base stocks used in the greases included bright stock, 200 neutral paraffin, and Duosol extract. Greases were heated in ovens at 200° F. and 300° F. to simulate rail car grease shipments during the summer and winter months, respectively, and also to simulate the temperatures expected in the traction motor gear boxes. Several greases containing standard soap and base oil, but no EP additive, were heated at 200° F. and at 300° F., for a total of 168 hours. These greases, which had initial Brookfield viscosities at 200° F. varying from 20,000 to 40,000, showed no decrease in viscosity at either temperature for the time period tested. Similar greases containing EP agents showed a loss in viscosity at the same temperatures and over the same time period varying from as low as 20% to as high as 93%. Similar results were obtained with greases containing complex soaps.

The tests established that major reductions in viscosity of the greases occurred at temperatures at which the greases were transported and stored and at temperatures encountered during use in the traction motor gear boxes. The data also established that the reductions in viscosity encountered were due to reaction of the EP agents with soap dispersed in the grease. In some of the tests, the greases ultimately lost essentially all of their viscosity and became as fluid as the base oils. Such greases would quickly leak from a gear box and thus would be totally ineffective as lubricants.

According to this invention, stable greases comprising a soap, an EP agent, and a base oil are prepared in which the amount of soap used is in excess of that required to thicken the grease to the desired viscosity. When an oil insoluble EP agent is used, the soap is prepared in such a manner that the grease contains undispersed soap solids as well as dispersed soap. As the EP agent slowly reacts with the dispersed soap, undispersed soap solids then become dispersed in the grease through the shearing or milling action of the gears being lubricated. With the correct selection of the soap and EP agent and the amount of each of these materials, it is possible to provide a balanced system whereby sufficient dispersed soap is present at all times to maintain the desired viscosity of the grease.

When an oil soluble EP agent is used, the soap is prepared in such a manner that when it is combined with the base oil it will be substantially entirely dispersed in such oil. The soap is then contacted with the EP agent, which quickly reacts with a portion of the soap to neutralize or substantially neutralize the reactivity of the EP agent. The remaining soap dispersion is then combined with the base oil to form a stable grease.

2. The Prior Art

Japanese Pat. No. 60-173,097 to Idemitsu Kosan KK relates to a lubricating oil composition prepared by adding to a base oil a phosphoric acid or its amine salt and at least one compound of the fatty acid type additive.

German Pat. No. 1,909,804 to Norway discloses a lubricating composition comprising a lubricating oil, phosphate and a salt of a fatty acid wherein the ratio of the fatty acid to the phosphate is about 1:1 to 3:1 and the total amount of the phosphate and fatty acid salt is about a to 50% by weight of the whole lubricant.

British Pat. No. 830,887 to Esso Research & Engineering Company discloses a high temperature grease for use in anti-friction bearings comprising a lubricating oil, from 15 to 40 weight percent of a soap comprising sodium crotanate and the sodium salt of an unsaturated monocarboxylic acid containing 14 to 22 carbon atoms and 0.1 to 15.0 weight percent di- or tri-sodium phosphate, said crotanate, unsaturated sodium salt and phosphate having been heated to a temperature of from 300° F. to 425° F. for from 20 minutes to 4 hours while in admixture with at least a portion of said lubricating oil.

DETAILED DESCRIPTION OF THE INVENTION

The soaps used in the preparation of the greases of this invention are the alkali and alkaline earth metal soaps of fatty acids, fatty glycerides, and fatty esters, and hydroxyl-containing fatty acids, fatty glycerides, and fatty esters. These materials, which may be either straight chain or branched, contain from about 10 to about 30 carbon atoms, and preferably from about 16 to about 20 carbon atoms. The choice of the metal component of the soap depends to an extent on the use for which the grease is intended. Metal components include the alkali metals and the alkaline earth metals found in groups 1A and 2A of the periodic table of elements. Useful alkali metals include lithium, sodium and potassium. Particularly preferred of the alkali metals is lithium. Useful alkaline earth metals include magnesium, calcium and barium. Calcium, of the alkaline earth metals, is usually preferred. A preferred soap for use in the grease compositions of this invention is lithium 12-hydroxy stearate.

In addition to the soaps described, it is also possible to use complex soaps in the preparation of the grease compositions. Complex soaps may be prepared from a variety of materials and are described in numerous patents and publications. As an example, complex soaps may be prepared from the reaction of alkali and alkaline earth metal hydroxides and carbonates with a dibasic acid, i.e. adipic acid, azealic acid or sebacic acid.

The soaps which were used in the testing program previously described were prepared in a "Stratco Contactor." A pressure vessel containing baffles and a mixer in which it is possible to obtain rapid circulation and thorough mixing. In the general procedure for making a soap in a "Stratco Contactor," the fatty material and a portion of the base oil are added to the vessel with the base, e.g. lithium hydroxide and a measured amount of water. After the vessel is closed, agitation and heating are carried on until a stated temperature and/or pressure is reached, at which point saponification will be complete. This usually occurs when the charge has reached a temperature of about 370° F. and a pressure of approximately 70 PSIG. Most of the moisture present in the pressure vessel is then flashed off by releasing the pressure on the contactor. Following blowdown the temperature in the contactor is increased to 400° F. to complete melting of the soap. At this point a part of the additional oil used in the grease is blended into the mixture. The soap-oil mixture is then transferred to an open vessel where the remainder of the oil can be introduced gradually, after which the entire mass can be smoothed down and cooled or allowed to cool. If desired, the smoothing or working step in processing the lubricating grease may be a part of the cooling operation.

Soaps are also prepared in open kettles at atmospheric pressure. In the basic open-kettle process, the fatty material is added to a portion of the base oil and heated with stirring until completely melted. A solution of alkali metal reactant, such as lithium hydroxide, is then added to the kettle with stirring to saponify the acid and form the soap which is dispersed in the base oil. Heat is then provided to the kettle until the water is completely removed and the soap is melted. At this point the soap is combined with the remainder of the base oil while stirring and maintaining an elevated temperature. When the desired viscosity is obtained, EP agent is added to the grease.

The major advantage of the pressure contactor over the open kettle is the time required for the manufacture of grease. Because of more rapid circulation and mixing, the pressure contactor requires one-fourth to one-fifth the time needed for grease preparation in the open kettle. The pressure contactor also has the advantage of providing a grease in which the soap is more finely and evenly dispersed in the grease.

The greases of this invention are prepared by both the open kettle and the pressure vessel methods, depending on the solubility of the EP agent incorporated in the grease. When the EP agent is oil soluble, a pressure contactor such as the "Stratco Contactor" is used. After the soap has been prepared utilizing the procedure previously described, it is combined with the EP agent. Reaction of the oil soluble EP agent with the dispersed soap is very rapid and the agent quickly consumes dispersed soap until the reaction is complete. The reaction of soap and EP agent may be allowed to take place in the contactor or may be effected in the transfer line from the contactor or in a separate vessel. Carrying out the reaction in the contactor may not be advantageous as the contactor may have to be cleaned after each operation in order to remove any residual EP agent.

The amount of soap used in the contactor method is measured to provide for complete reaction of soap and EP agent and still leave sufficient soap to obtain the desired viscosity in the grease composition. After reaction of the EP agent and soap dispersion is complete, the soap is pumped to an open kettle where the remainder of the base oil is added and the mixture is circulated until the desired viscosity is reached. Since the reactivity of the EP agent with the soap is no longer a factor, the grease may be used with the confidence that the viscosity will be maintained at the desired level.

When an oil insoluble EP agent is used, the grease-making process is carried by a modified open kettle procedure. In this case the soap is not melted; therefore, an excess must be blended with the base oil to produce the desired consistency as previously described (and as set forth in more detail in Example 1). After the desired viscosity has been obtained, the EP agent is blended into the grease. The open kettle process is carried out at a temperature between about 250° F. and about 350° F.. This temperature is sufficiently high to effect substantial dispersion of the soap in the grease, but not high enough to melt the soap. As a result, part of the soap remains in the grease as undispersed solids. The insoluble EP agent reacts preferentially with the dispersed soap. As dispersed soap is used up, undispersed solids in turn become dispersed in the grease through the shearing and milling action obtained when the grease is placed in use. By appropriately controlling the amount of soap used in the process, it is possible to provide a balanced system wherein sufficient soap is present in dispersion at all times to maintain the desired viscosity of the grease composition.

While the procedures described are preferred, greases containing oil soluble EP agents may also be prepared in an open kettle by appropriately controlling mixing temperatures and other operating conditions to assure complete dispersion of the soap. Also the grease-making process with oil-insoluble EP agents may be carried out in a pressure contactor by operating in an appropriate manner to limit dispersion of the soap and thus obtain a grease containing undispersed soap solids.

A variety of mineral oils of lubricating viscosity may be used as the base oil in the grease compositions of the invention. Included are such materials as bright stock, Duosol extract, and neutral oils. The mineral oil base can be a single oil or it can be a mixture of oils. The combined oils should have a viscosity within the range of about of 50 to about 200 SUS at 200° F. The oils may be napthenic base, paraffin base, or mixed base oils derived from petroleum, including lubricating oils derived from coal products.

EP agents or film strength additives contain chemical elements in such a form that under high pressure between metal surfaces they react with the metal to form a coating which will either sustain the load or prevent welding of the two metals together. The active ingredient in EP agents is either chlorine, phosphorous, or sulfur compounds. The additives often consist of phosphates, phosphites, sulfurized esters, and sulfurized olefins. U.S. Pat. No. 2,566,793 lists a variety of EP agents, including esters of phosphorous acids, neutral aromatic sulfur compounds, selenides, sulfurized fatty oils or esters, sulfurized long-chain olefins, phosphorous acid esters having sulfurized organic radicals and chlorinated hydrocarbons. Commercial products available include the materials previously mentioned, viz., Lubrizol 6063, Lubizol 887, Sulperm 110 and Hitec 2319. Other commercial products include such materials as Anglalmol 33, an olefin polysulfide; Vanlube 829, substitutwd 1, 3, 4 thiodiazole; Vanlube 804, a sulfurized olefin and organic phosphate; Cuvan 826, 2,5 dimercapto 1,3,4 thiodiazole; Pennwalt TNPS, a tertiary nonyl polysulfide; Mobil G-305 and G-500, sulfurized ester organic phosphate; Elco L-36556, zinc dialkyldithiophosphate and organic boron; and Elco 36715, zinc dialkyldithiophosphate, organic boron, sulfurized oils, alkyl phosphate and amines. Some of the EP agents are substantially oil insoluble; however, most of them are oil soluble.

The grease compositions of this invention will normally contain from about 1.0 to about 5.0 weight percent dispersed soap. In any event, the amount of soap used in the grease preparation will be established to provide sufficient soap for reaction with the EP agent and the additional amount of undispersed necessary to provide a soap dispersion in the grease which is sufficient to maintain the desired grease viscosity. The amount of EP agent used will depend on the particular EP material, but will usually be from about 1.0 to about 3.0 weight percent of the grease.

Various other additives may be incorporated into the grease compositions of this invention subject only to the requirement that they are compatible with the required components of the invention and with each other. Typical additives which may be incorporated include rust inhibitors, oxidation inhibitors, stringiness agents, dyes and other color additives, dispersants, antiwear agents and the like. These optional additives are present in the grease compositions in only small amounts, usually not exceeding about 3% by weight.

The greases of this invention are further illustrated in the following examples.

EXAMPLE 1

Three greases were prepared in an open kettle utilizing the procedure set forth in Table 1.

TABLE 1

1. Charge cooking oil to kettle.
2. Heat to 180° F.
3. Add 12-hydroxystearic acid and hydrogenated castor oil.
4. Heat to 190° F., stir until completely melted.
5. Prepare a solution of lithium hydroxide in hot water.
6. Add solution to kettle while stirring.
7. Adjust steam on cooking kettle to give a moderate release of water without excessive splattering.
8. Cook until water is gone.
9. Pump extract into blend tank.
10. Add soap while stirring.
11. Circulate with stirring at 190–200°.
12. Shear at 60 psi pressure until desired viscosity is reached.
13. When desired viscosity is attained, add EP additive shear in at 30 psi.
14. Sample for final viscosity.

The composition of the greases is shown in Table 2.

TABLE 2

| | No. 1 | | No. 2 | | No. 3 | |
|---|---|---|---|---|---|---|
| | lb | Wt % | lb | Wt % | lb | Wt % |
| Hydrogenated Castor Oil | 32.0 | 2.13 | 36.9 | 2.46 | 65.7 | 3.29 |
| 12 Hydroxy Stearic Acid | 10.7 | 0.71 | 12.4 | 0.83 | 22.0 | 1.10 |
| Lithium Hydroxide | 6.1 | 0.41 | 7.0 | 0.47 | 12.3 | 0.62 |
| Bright Stock | 215.4 | 14.36 | 214.3 | 14.29 | 283.5 | 14.17 |
| DuoSol Extract | 1220.8 | 81.39 | 1214.4 | 80.96 | 1596.5 | 79.82 |
| Van Lube 829 | 15.0 | 1.00 | 15.0 | 1.00 | 20.0 | 1.00 |

The three greases were tested in the traction motors of a test locomotive pulling 88 cars of 100 tons each. Test conditions and results are presented in Table 3.

TABLE 3

| | No. 1 | No. 2 | No. 3 |
|---|---|---|---|
| Initial Viscosity* - cP | 7,000 | 9,400 | 8,250 |
| Test Mileage | 500 | 500 | 2,760 |
| Gear Box Temperature - °F. | 100–175 | 100–175 | 75–125 |
| Final Viscosity* - cP | 53,000 | 55,000 | 63,800 |

*Brookfield viscosity at 200° F.

The greases did not reach temperatures in the test which would be expected in normal railroad operations. To determine the effect of higher temperature the greases were heated in an oven at a temperature of 200° F., with the results set forth in Table 4.

TABLE 4

| | No. 1 | No. 2 | No. 3 |
|---|---|---|---|
| Heating time - hrs | 192 | 192 | 168 |
| Viscosity after Heating - cP | 23,000 | 25,000 | 24,000 |

EXAMPLE 2

A grease is prepared by combining 1,400 lb of brightstock, 375 lb of hydrogenated castor oil, 125 lb of methyl-12-hydroxy stearate, 72 lb of lithium hydroxide monohydrate and 50 lb of water in a Stratco Contactor. With the contactor closed the mixture is agitated and heated to a temperature of 370° F. The pressure on the contactor is then released to blow off water and the contactor temperature is increased to 400°F. to complete melting of the soap. The temperature is then reduced to 350° F. by adding 1,000 lb of brightstock. The insoluble EP agent (500 lb of Vanlube 829) is then added to the soap and reaction occurs between the EP agent and approximately 250 lb of the soap. Following addition of the EP agent, the contents of the contactor are transferred to an open kettle and 13,000 lbs of dusol extract are added. Thereafter the entire mass is smoothed down and allowed to cool. The viscosity of the cooled grease is 15,000 cP Brookfield, measured at 200° F. When the grease is tested in a locomotive gear box in a similar manner to that set forth in Example 1, the viscosity remains essentially unchanged.

We claim:

1. A stable grease composition comprising:

(a) a base oil, (b) an oil insolube extreme pressure agent, (c) from about 1 percent to about 5 percent dispersed metal soap, and (d) an excess of undispersed soap formed at temperatures of about 370° C. or less.

2. The composition of claim 1 in which the soap is a lithium soap.

3. The composition of claim 2 in which the soap is lithium 12-hydroxy stearate.

4. A stable grease composition comprising:

(a) a base oil combined with the reaction product of (b) an oil soluble extreme pressure agent and dispsersed metal soap, and (c) from about 2 percent to about 5 percent additional dispersed metal soap.

5. The composition of claim 4 in which the soap is a lithium soap.

6. The composition of claim 4 in which the soap is lithium 12-hydroxy stearate.

7. A process for preparing a stable grease composition comprising:

(a) preparing a soap containing dispersed and undispersed soap solids, said undispersed soap solids having been prepared at temperatures of 370° C. or less;

(b) blending with a base oil an amount of said dispersed and undispersed soap sufficient to provide from about 1 to 5 percent dispersed soap and to thicken the stable grease composition to the desired viscosity; and (c) blending with the dispersed and undispersed soap and base oil and oil insoluble extreme pressure agent; whereby dispersed soap which reacts with the extreme pressure agent is replaced by dispersion of undispersed soap solids during use of the grease for lubrication, said dispersion of undispersed soap solids occurring in an amount sufficient to maintain the desired grease viscosity.

8. The process of claim 2 in which the soap is a lithium soap.

9. A process for preparing a stable grease composition comprising:

(a) preparing a lithium 12-hydroxy stearate soap containing both dispersed soap and undispersed soap solids, said undispersed soap solids prepared at a temperature of 370° C. or less;

(b) blending with a hydrocarbon base oil with sufficient amounts of the mixture of (a) to provide from about 1.0 to about 5.0 weight percent of dispersed soap, sufficient to thicken the stable grease composition to the desired viscosity; and (c) blending the soap and base oil with Vanlube 829 extreme pressure agent; whereby soap dispersed in step (b) which reacts with the Vanlube 829 extreme pressure agent is replaced by the dispersion of undispersed soap solids during use of the grease for lubrication, said dispersion of undispersed soap solids occuring at a sufficient rate to maintain the desired grease viscosity.

10. A process for preparing a stable grease composition comprising:

(a) preparing a soap dispersion essentially free of undispersed soap solids, (b) blending with an oil soluble extreme pressure agent an amount of said soap sufficient to totally react with an extreme pressure agent additive and to thereafter thicken the stable grease composition to the desired viscosity with unreacted soap; and (c) blending a base oil with the reaction product of the soap soluble extreme pressure agent and unreacted dispersed soap; whereby after reaction of the EP agent and dispersed soap, sufficient soap remains dispersed to maintain the desired grease viscosity.

11. The process of claim 10 in which the soap is a lithium soap.

12. The process of claim 11 in which the amount of soap used is between about 1.0 and about 5.0 weight percent.

13. A process for preparing a stable grease composition comprising:

(a) preparing a lithium 12-hydroxy stearate soap dispersion essentially free of undispersed soap solids, (b) blending with an oil soluble extreme pressure agent sufficient dispersed soap react with said extreme pressure agent and provide about 1.0 to about 5.0 weight percent of unreacted soap, an amount which is in excess of that required to thicken stable grease composition to the desired viscosity; and (c) blending a hydrocarbon base oil with a soap and oil soluble EP agent; whereby after reaction of the extreme pressure agent and dispersed soap, sufficient soap remains dispersed to maintian the desired grease viscosity in use.

* * * * *

UNITED STATES PATENT AND TRADEMARK OFFICE

CERTIFICATE OF CORRECTION

PATENT NO. : 4,842,752

DATED : June 27, 1989

INVENTOR(S) : Bryant J. Hardy and Charles J. Swartz

It is certified that error appears in the above-identified patent and that said Letters Patent is hereby corrected as shown below:

Column 2, line 47, "1,909,804" should be --1,090,804--.

Column 5, line 1, "200", first occurrence, should be --2000--.

Column 5, line 20, "Lubizol" should be --Lubrizol--.

Column 5, line 36, "stitutwd" should be --stituted--.

Column 7, line 28, "2" should be --1--.

Signed and Sealed this

Sixth Day of March, 1990

*Attest:*

JEFFREY M. SAMUELS

*Attesting Officer*

*Acting Commissioner of Patents and Trademarks*